United States Patent [19]

Faller

[11] Patent Number: 4,985,606

[45] Date of Patent: Jan. 15, 1991

[54] MULTI-PLY FILM SUSCEPTOR FOR MICROWAVE COOKING

[76] Inventor: Rudolph Faller, 7101 Mark Terrace Dr., Edina, Minn. 55435

[21] Appl. No.: 430,966

[22] Filed: Nov. 1, 1989

Related U.S. Application Data

[63] Continuation of Ser. No. 252,594, Oct. 3, 1988, abandoned.

[51] Int. Cl.[5] ..... H05B 6/80

[52] U.S. Cl. ..... 219/10.55 E; 219/10.55 F; 426/107; 426/234; 126/390

[58] Field of Search ..... 219/10.55 E, 10.55 F; 426/107, 113, 234, 243, 241; 99/DIG. 14; 126/390; 428/34.2, 35.8, 35.9; 229/903, 906

[56] References Cited

U.S. PATENT DOCUMENTS

| | | | |
|---|---|---|---|
| 4,267,420 | 5/1981 | Brastad | 219/10.55 E |
| 4,641,005 | 2/1987 | Seiferth | 219/10.55 E |
| 4,676,857 | 6/1987 | Scharr et al. | 219/10.55 E X |
| 4,713,510 | 12/1987 | Quick et al. | 426/107 X |
| 4,735,513 | 4/1988 | Watkins et al. | 426/113 |
| 4,777,053 | 10/1988 | Tobelmann et al. | 426/107 |
| 4,835,352 | 5/1989 | Sasaki et al. | 219/10.55 E |
| 4,865,921 | 9/1989 | Hollenberg et al. | 219/10.55 E |

*Primary Examiner*—Philip H. Leung

[57] ABSTRACT

A multi-ply susceptor for microwave cooking is formed by a first plastic film capable of withstanding microwave cooking high temperatures, at least a second plastic film capable of withstanding microwave cooking temperatures and having one of its surfaces bonded to the first layer, a thin metal coating of microwave-sensitive metal formed on one surface of one of the first and second plastic films so that it is sandwiched between them, and a substrate on which the other surfaces of the second layer is supported. Microwave radiation is transmitted through the first plastic film and converted into heat by the thin metal coating, and the second plastic film acts as a heat buffer to collect and more evenly distribute heat to the first layer.

13 Claims, 3 Drawing Sheets

MULTI-PLY FILM SUSCEPTOR FOR MICROWAVE COOKING

This application is a continuation of application Ser. No. 252,594, filed Oct. 3, 1988, now abandoned.

FIELD OF THE INVENTION

This invention generally relates to a susceptor structure for microwave cooking, and more particularly, to a susceptor structure having multiple film layers selected for improved heat control, structural integrity, and safety.

BACKGROUND ART

In the art of microwave cooking, it is desirable that the exterior of certain types of food be browned or made crisp to have the texture and appearance of conventionally fried, baked, or roasted foods. The recooking of foods in a conventional oven after microwave cooking to achieve this condition is complicated and inconvenient for the user. Therefore, attempts have been made to develop food receptacles and packaging which can obtain the desired browning or crisping effect.

A recent development has been the use of microwave susceptors for food packaging and receptacles. For example, as disclosed in U.S. Pat. No. 4,641,005 to Seiferth, a susceptor structure is made of a plastic film coated on one side with a metal layer and bonded to a backing sheet of paper, paperboard, or non-thermoplastic material. The metal layer is designed to absorb microwave radiation and generate conductive heat to be transmitted through the plastic film to the surface of the food. However, such metallized film susceptors have the problem that the density of the metal layer necessary to provide sufficient heat to cook the food surface can generate excessive heat in other areas of the sheet which are not in contact with the food. Excessive heat can cause cracking, crazing, shrinking, or embrittlement of the plastic film. Susceptor temperatures above 450 degrees may result in combustion or volatilization of the various susceptor components, and subsequent contamination of the food.

One attempt to correct the above-mentioned problem of areas of excessive heat in susceptors is shown in U.S. Pat. No. 4,735,513 to Watkins, wherein the metal layer is formed as one or more separate islands of smaller area than the food receptacle as a whole, with a shape or shapes corresponding to that of the food to be cooked. This allows heat to be generated only in the defined areas intended to be placed in contact with food. However, the individual metal layers have to be separately positioned and sandwiched in between protective backing layers in one fabrication step, in order to properly position them at the intended sites of the food, to provide dimensional stability, and to prevent them from becoming delaminated from the plastic film. This requirement results in a more complicated and exacting fabrication process, and requires the fabrication of many different types of susceptor configurations depending on the shapes of food to be cooked or the food receptacles to be made from the susceptor material.

In view of the above-mentioned problems and disadvantages of the prior art, it is a principal object of the invention to provide an improved susceptor structure which efficiently converts microwave radiation into heat and distributes the heat relatively evenly over its surface area so that excessive heat generation, deterioration of the susceptor, and burning or contamination of the food are prevented. It is a further object of the invention that the improved susceptor structure can be easily fabricated in web or sheet form without requiring the complicated positioning of constituent parts or many different shapes for different uses.

SUMMARY OF THE INVENTION

In accordance with the invention, an improved susceptor for microwave cooking comprises: a first layer having a first plastic film capable of withstanding high temperatures encountered in microwave cooking, at least a second layer having a second plastic film capable of withstanding microwave cooking temperatures and having one of its surfaces bonded to the first layer; a thin metal coating of microwave-sensitive metal formed on one surface of one of the first and second films such that it is sandwiched between the two films; and a backing layer on which the other surface of the second layer is supported, wherein microwave radiation is transmitted through the first plastic film and at least partially converted into heat by the thin metal coating, and the second layer acts as a heat buffer to collect and distribute heat to the first layer.

In a preferred embodiment of the invention, the first and second plastic films are made of clear polyethylene terephthalate (PET) film and are bonded together by an adhesive layer. The thin metal coating is applied to the first plastic film in an amount which provides about 50%–65% optical transmissivity. The second plastic film may also have a thin, microwave-sensitive metal coating applied on its other surface, and a third, clear plastic film may be interposed between the second layer and the backing layer. The backing layer may be composed of paper board paper, or other suitable substrates.

The second layer functions to progressively collect heat converted by the thin metal coating of the first layer and distributes it more evenly to the top, food-contacting surface of the first plastic film. A three-layer susceptor structure having two metal-coated plastic film layers and a third, clear plastic film layer provides improved thermal conversion with a lower level of metallization in each layer. The invention avoids the generation of uneven or excessive heat at the food-contacting surface, provides a faster, more uniform cooking of the surface of the food, and prevents cracking, crazing, or other film deterioration. The improved susceptor structure can be easily fabricated by bonding the layers together with the backing layer, and can be used to make a wide variety of food holding pads, sleeves, trays, bags, folding cartons, containers, etc.

Other objects, features, and advantages of the present invention will become apparent from the following description of the preferred embodiments of the invention considered with the drawings, as follows:

DESCRIPTION OF PREFERRED EMBODIMENTS OF THE INVENTION

Figure 1:
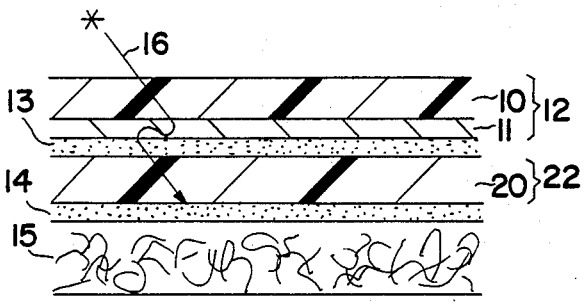
FIG. 1 is a side sectional view of a multi-ply susceptor structure in accordance with the invention.

Referring to FIG. 1, a first embodiment of the improved multi-ply susceptor structure of the invention has a first plastic film 10 with a thin metal coating 11 applied to its bottom surface opposite from the top, food-contacting surface. The first plastic film 10 and thin metal coating 11 together constitute a first layer 12. The first layer 12 is bonded by an adhesive layer 13 to the upper surface of a second plastic film 20, which constitutes a second layer 22. The second layer 22 is bonded by an adhesive layer 14 to a substrate 15 which forms a backing layer providing dimensional stability to the composite layered structure.

Figure 2:
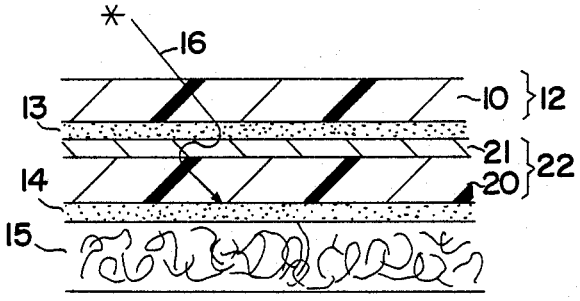
FIG. 2 is a side sectional view of another embodiment of the invention.

In the embodiment of FIG. 2, the first layer 12 consists of an unmetallized (clear) first plastic film 10 bonded by the adhesive layer 13 to the second layer 22. The second layer 22 consists of an upper metal layer 21 on the second plastic film 20, and the lower surface of the second plastic film 20 is bonded by the adhesive layer 14 to the substrate 15.

Figure 3:
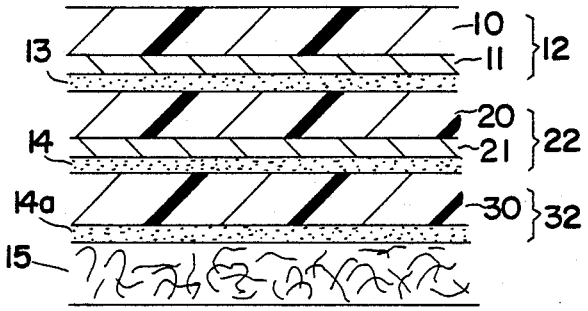
FIG. 3 is a side sectional view of a further embodiment of the improved susceptor structure.

In FIG. 3, a further embodiment has two metallized plastic film layers 12 and 22, and a clear, third plastic film 30, which constitutes a third layer 32, bonded at its upper surface by the adhesive layer 14 to the second layer 22, and bonded at its lower surface by another adhesive layer **14*a* to the substrate 15. The second metallized film layer 22 is provided in order to convert the remainder of the microwave radiation penetrating past the first layer into heat. This structure increases the efficiency of heat conversion and distribution, and allows a lower level of metallization to be used in either or both metal layers, thereby further avoiding the creation of "hot spots" of excessive heat. The clear plastic film 30** is provided under the metallized second layer to moderate and distribute the heat generated therein and further prevent uneven thermal stresses from occurring.

In accordance with the principles of the invention, the uncoated top surface of the first plastic film 10 is placed in contact with the food load. The plastic film is selected to be transmissive to microwave radiation, as indicated by ray 16. One thin metal coating is positioned between the first and second plastic films 10 and 20. The microwave radiation impinges on the thin metal coating 11 of the first layer 12 in FIGS. 1 and 3, or the metal coating 21 of the second layer 22 in FIG. 2, and is at least partially absorbed therein and converted into heat energy. It has been found that the microwave energy diminishes by about 40% while passing through the microwave reactive coating. Part of the heat energy is radiated upward to the food-contacting surface of the first plastic film 10, while the remainder is collected or stored progressively by the second layer 22 as the susceptor is exposed to microwave radiation over time.

As the temperature of the second layer 22 rises, the collected heat energy is transmitted by the second layer 22 back to the first layer 12. The second layer thus acts as a heat buffer which transmits a more uniform distribution of heat to the food-contacting surface where the heat is absorbed by the food load. For the areas of the susceptor which are not in contact with the food, the second layer 22 will have the moderating effect of absorbing and distributing the heat more evenly across its profile. Since heat is distributed in the second layer 22 and transmitted back to the first layer, the heat energy generated by the metal layer 11 is more efficiently utilized, and a lower level of metallization can be used to obtain a desired temperature at the food-contacting surface. These effects reduce the likelihood of cracking, crazing, or other deterioration of the film frequently seen in conventional susceptor structures.

The average surface temperature for the food-contacting surface of the multi-ply susceptor can be better controlled by selecting a suitable degree of metallization and the thicknesses of the first and second plastic films. For microwave cooking, the surface temperature should be lower than 450 degrees Fahrenheit in order to avoid deterioration of the susceptor and burning of the food. A preferred range of surface temperature is about 350 to 400 degrees, which will achieve good browning and crisping of the food surface.

The metal coating preferably has a thickness of the order of several hundred Angstroms or less. A substantially greater thickness of the metal layer would cause too much heat to be generated and might result in electrical arcing. The metal layer can be applied by vacuum vapor deposition, sputtering, or other thin coating methods. Suitable metals are aluminum, nickel, and metal alloys such as stainless steel. Since it is difficult to measure the thickness of a thin film mechanically, the amount of metal coating is measured herein in terms of light transmissivity of the resultant metallized film. In general, the more metal deposited, i.e. lower percentage of transmissivity, the higher will be the average surface temperature of the susceptor.

The plastic films are preferably made of clear polyester (PET) film which has a high temperature resistance. Other suitable plastic film materials include polyethylene terephthalate, polysulphone, polycarbonate and polyamids. Suitable adhesives for bonding the plastic film layers and the substrate together include emulsion-based polymer adhesives, such as polyvinyl acetate resin. The type of adhesive used can play an significant role in impeding or facilitating the transfer of heat through the layers. The backing layer can be made of paper board, kraft paper, other cellulosic materials, glassine materials, ceramics, or non-thermoplastic synthetic materials such as thermoset polyamid, melamine, and phenolic fiber.

Figure 4:
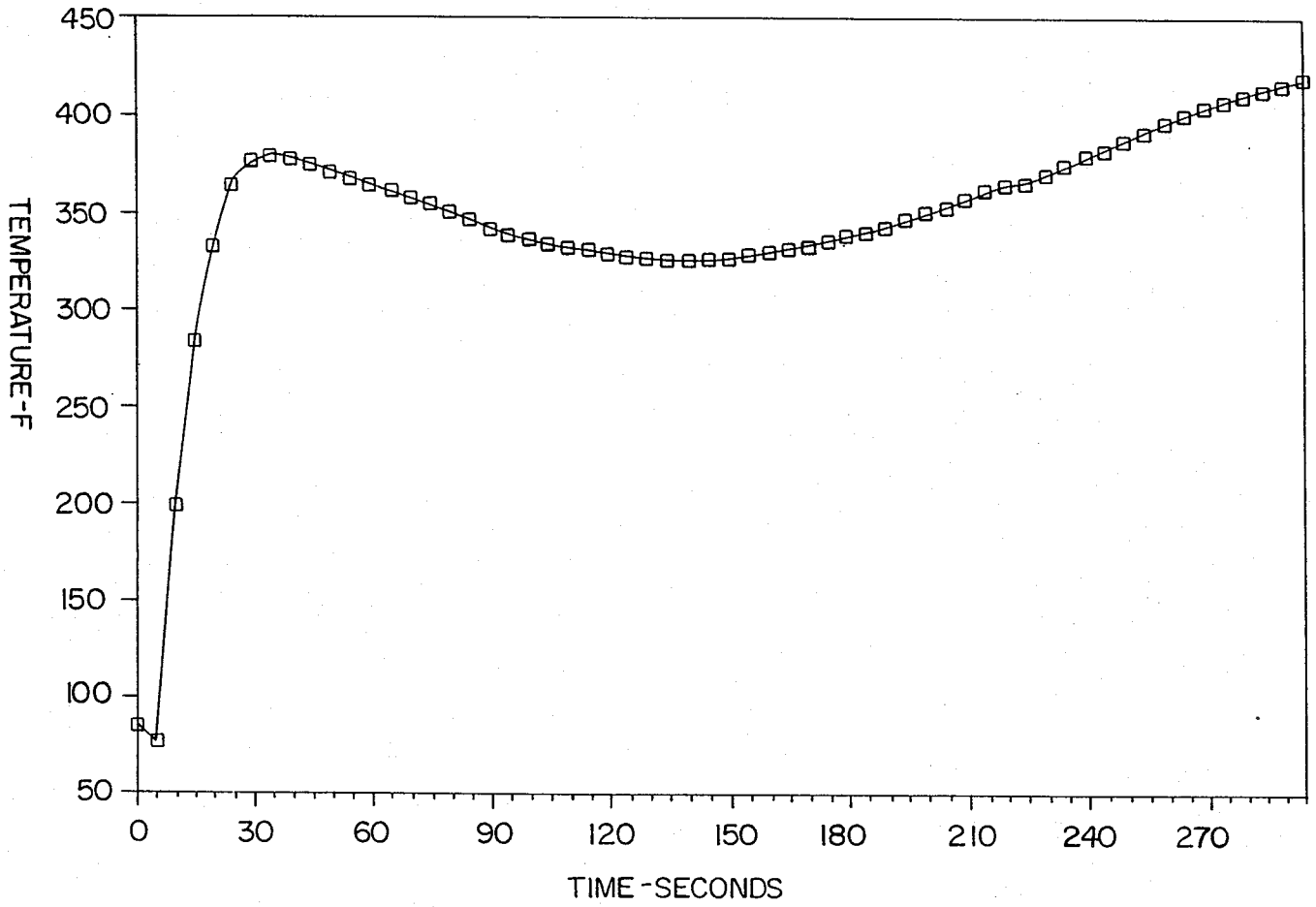
FIG. 4 is a diagram of average temperature as a function of time provided by a susceptor structure according to FIG. 1.

Referring to FIG. 4, an example of the susceptor structure of FIG. 1 was made of a first layer of clear PET film with a metal coating having light transmissivity in the range of 60%, and a second layer of clear, uncoated PET film. The light transmissivity of the metallized layer was measured by passing visible light from one side to a receiving gauge on the opposite side of the layer. The adhesive was polyvinyl acetate made by National Starch & Chemical Corp. of Bridgewater, N.J. The substrate was 0.017 solid bleached sulphate paperboard made by Federal Paper Board Co., Inc., of Mondale, N.J. A food sample of breaded fish sticks of 4 ounces was placed on the susceptor in a conventional microwave oven of 700 watts power output. Four surface probes were used to measure average surface temperature with fiber optic instrumentation. The measurements were taken every 5 seconds for 300 seconds.

As shown in FIG. 4, the surface temperature of the susceptor rose rapidly as heat was generated in the metal layer, then decreased as heat was transferred to the food surface, then rose to higher temperatures with sustained microwave exposure. Average surface temperatures in the preferred range of 350 to 400 degrees were obtained using the multi-ply susceptor structure of the invention. In particular, the results in FIG. 4 showed a desirably flat, average surface temperature response.

Figure 5:
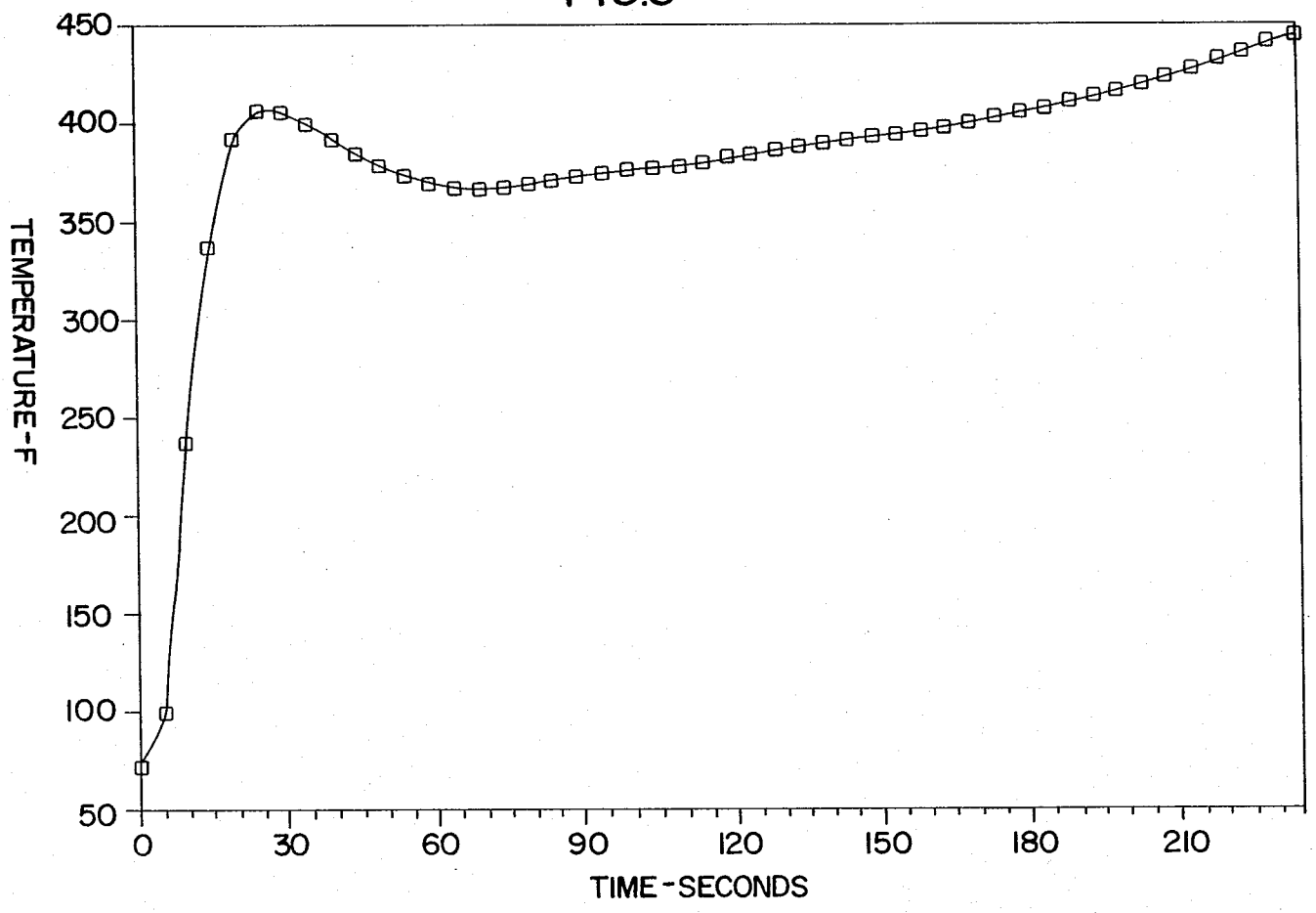
FIG. 5 is a diagram of average temperature as a function of time provided by a susceptor structure according to FIG. 3.

Referring to FIG. 5, an example of the susceptor structure of FIG. 3 was made of two metallized plastic film layers and a clear third film. A level of aluminum metallization equal to 60% light transmission was used on the lower surface of the top plastic film. The level of metallization on the second plastic film was equal to about 65% light transmission.

The results in FIG. 5 show that the two metallized layers provide an increased conversion efficiency of microwave energy to heat. Besides full-size ovens, microwave oven manufacturers produce compact ovens which have a lower power capability such as, for example, 400 watts. A susceptor structure having two metallized layers, which provides a higher surface temperature response in a higher power oven, e.g. 400 degrees, can also be used in a lower power oven with a somewhat lower, but still acceptable, temperature response, e.g. in the range of 350 degrees. The use of multiple metallized films also allows heat to be distributed more evenly through the profile of the susceptor, as indicated in FIG. 5, thereby producing a more uniform surface temperature response.

In the conventional susceptor having a single metal-coated plastic film layer, if a higher metallization level is used to obtain sufficient surface temperatures in the cooking area, the surface temperature may rise unacceptably high over prolonged exposure, and excessive heat is generated in areas not in contact with the food. If temperatures exceed 450 degrees in "hot spot" areas, volatilization and burning of the susceptor fibers, adhesives, and additives can occur, thereby risking the release of noxious substances and contamination of the food. If a lower metallization level is used, the conversion efficiency is lowered, and the susceptor may be unsuitable for use in lower power ovens.

From the foregoing description, it will be recognized by those skilled in the art that the present invention provides a susceptor structure which avoids the problems of excess heat generation and loss of structural integrity while allowing for consistent and controlled heating at desired cooking temperatures at the food-contacting surface. The use of two metal-coated plastic film layers and a clear, high temperature third film is particularly advantageous in that it is suitable for use in lower power ovens and provides a more even surface temperature response. The susceptor can be easily fabricated by bonding the metal-coated and/or uncoated plastic film layers in sheet form to the substrate layer.

Numerous modifications would of course be apparent to those skilled in the art from the above disclosure. Although the invention has been described with reference to certain preferred embodiments, it will be appreciated that other variations of film, adhesive, release coatings, and substrate materials, metallization techniques, number of layers, etc., may be devised, which are nevertheless considered to be within the spirit and scope of the invention as defined in the claims appended hereto.

What is claimed is:

1. A multi-ply susceptor for microwave cooking comprising:

a substantially planar first layer having a first microwave-transmissive plastic film capable of withstanding high temperatures encountered in microwave cooking, said first layer having an upper surface on which food to be cooked is placed and which is exposed to microwave radiation impinging thereon and passing therethrough to a lower surface thereof;

at least a second layer having a second plastic film capable of withstanding microwave cooking temperatures disposed in parallel below said first layer;

a thin metal coating of microwave-sensitive metal located below and deposited in contact with said lower surface of said first layer and sandwiched between said first layer and an upper surface of said second layer, wherein said thin metal coating is deposited in an amount which results in about 50%–65% light transmission, such that a part of the microwave radiation passing through said first layer is absorbed in said thin metal coating and converted to heat energy which is radiated back upward to the food-contacting upper surface of said first layer, and a remaining part of the microwave radiation is transmitted to said second layer; and a thermally and dimensionally stable substrate below said second layer on which a lower surface of said second layer is supported, wherein microwave radiation is transmitted through said first plastic film and converted into heat by said thin metal coating, and said second layer acts as a heat buffer to collect and distribute heat generated by said thin metal coating to said first layer so that surface cracking or crazing of the upper surface of said first layer in contact with the food to be cooked is reduced.

2. A multi-ply susceptor according to claim 1, wherein said second plastic film has another thin metal coating formed on its lower surface facing said substrate.

3. A multi-ply susceptor according to claim 2, further comprising a third layer formed by a clear, third plastic film capable of withstanding microwave cooking temperatures bonded between said second layer and said substrate.

4. A multi-ply susceptor according to claim 3, wherein another thin metal coating is provided between said third layer and said substrate.

5. A multi-ply susceptor according to claim 2, wherein said thin metal coating is deposited on said first and second plastic films in an amount which results in about 55%–65% light transmission in each layer.

6. A multi-ply susceptor according to claim 5, wherein said thin metal coating is deposited on said first plastic film to about 60% light transmission and on said second plastic film to about 65% light transmission.

7. A multi-ply susceptor according to claim 1, wherein said first and second plastic films are made of clear polyester film.

8. A multi-ply susceptor according to claim 1, wherein an adhesive layer of heat resistant polymer is used to bond said first and second layers together.

9. A multi-ply susceptor according to claim 1, wherein said thin metal coating is deposited on said one plastic film in an amount which results in about 60% light transmission.

10. A multi-ply susceptor according to claim 1, wherein said substrate is made of paperboard or paper.

11. A multi-ply susceptor according to claim 1, wherein said thin metal coating is made of elemental aluminum deposited on said plastic film by vapor deposition to a thickness of several hundred Angstroms or less.

12. A multi-ply susceptor according to claim 1, wherein said thin metal coating is sandwiched between first and second plastic films made of high temperature-resistant resin material.

13. A multi-ply susceptor for microwave cooking comprising:

a substantially planar first layer having a first microwave-transmissive plastic film capable of withstanding high temperatures encountered in microwave cooking, said first layer having an upper surface on which food to be cooked is placed and which is exposed to microwave radiation impinging thereon and passing therethrough to a lower surface thereof;

an adhesive layer applied in contact with said lower surface of said first layer;

at least a second layer having a second plastic film capable of withstanding microwave cooking temperatures disposed in parallel below said first layer;

a thin metal coating of microwave-sensitive metal deposited on and in contact with an upper surface of said second layer and in adhesive contact with said adhesive layer, wherein said thin metal coating is deposited in an amount which results in about 50%-65% light transmission, such that a part of the microwave radiation passing through said first layer is absorbed in said thin metal coating and converted to heat energy which is radiated back upward to the food-contacting upper surface of said first layer, and a remaining part of the microwave radiation is transmitted to said second layer; and a thermally and dimensionally stable substrate below said second layer on which a lower surface of said second layer is supported, wherein microwave radiation is transmitted through said first plastic film and converted into heat by said thin metal coating, and said second layer acts as a heat buffer to collect and distribute heat generated by said thin metal coating to said first layer so that surface cracking or crazing of the upper surface of said first layer in contact with the food to be cooked is reduced.

* * * * *